US011288909B2

(12) United States Patent
Lantz et al.

(10) Patent No.: US 11,288,909 B2
(45) Date of Patent: Mar. 29, 2022

(54) SECURE COLLECTION DEVICE FOR PAPER BALLOTS

(71) Applicant: A. Rifkin Co., Hanover Township, PA (US)

(72) Inventors: Paul D. Lantz, Kingston, PA (US); Donald R. Casterline, Mountain Top, PA (US); Christopher M. Buck, Kingston, PA (US)

(73) Assignee: A. Rifkin Co., Hanover Township, PA (US)

( * ) Notice: Subject to any disclaimer, the term of this patent is extended or adjusted under 35 U.S.C. 154(b) by 1 day.

(21) Appl. No.: 16/903,885

(22) Filed: Jun. 17, 2020

(65) Prior Publication Data

US 2021/0005042 A1 Jan. 7, 2021

Related U.S. Application Data

(60) Provisional application No. 62/869,065, filed on Jul. 1, 2019.

(51) Int. Cl.
*G07C 13/02* (2006.01)

(52) U.S. Cl.
CPC ..... *G07C 13/02* (2013.01)

(58) Field of Classification Search
CPC ..... G07C 13/02
USPC ..... 232/2; 235/386
See application file for complete search history.

(56) References Cited

U.S. PATENT DOCUMENTS

| | | | | |
|---|---|---|---|---|
| 7,077,314 | B2 | 7/2006 | Johnson | |
| 7,273,139 | B2 | 9/2007 | Lantz | |
| 8,245,905 | B2 | 8/2012 | Lantz et al. | |
| 8,413,880 | B2 | 4/2013 | Kapsis | |
| 8,733,646 | B2 | 5/2014 | Bolton et al. | |
| 2001/0050306 | A1* | 12/2001 | Plumb | G07C 13/02 232/2 |
| 2009/0224030 | A1* | 9/2009 | Kapsis | G07C 13/02 235/51 |
| 2009/0283597 | A1* | 11/2009 | Charles | G07C 13/02 235/386 |
| 2012/0111941 | A1* | 5/2012 | Abel | G07C 13/02 235/386 |
| 2012/0187188 | A1* | 7/2012 | Schmidt | G07C 13/02 235/386 |
| 2014/0231513 | A1* | 8/2014 | Brockhouse | G07C 13/02 235/386 |

* cited by examiner

*Primary Examiner* — Michael G Lee
*Assistant Examiner* — David Tardif
(74) *Attorney, Agent, or Firm* — Wendy W. Koba, Esq.

(57) ABSTRACT

A secure ballot collection system is formed of a removable container that may be positioned within a voting machine and used for collecting paper ballots as they are cast. The container itself is capable of being sealed after removal from the voting machine to ensure the security of the paper ballots. The removable container is placed on a raised floor platform that is also positioned within the interior of the voting machine. The platform provides easy access to the interior of the voting machine from a side opening and allows for the ballot container bag to be located at a height where it is relatively straightforward for an election official to place an "empty" container bag at the beginning of the voting process, and also remove a "filled" container bag at some point in time thereafter.

7 Claims, 4 Drawing Sheets

SECURE COLLECTION DEVICE FOR PAPER BALLOTS

CROSS-REFERENCE TO RELATED APPLICATIONS

This application claims priority from U.S. Provisional Application No. 62/869,065, filed Jul. 1, 2019 and herein incorporated by reference.

TECHNICAL FIELD

The present invention relates to a receptacle for the collection of paper ballots during a voting process and, more particularly, to a removable system for inclusion within a voting machine for collecting paper ballots as they are cast, a container component of the removable system configured to be sealed after removal from the voting machine to ensure the security of the paper ballots.

BACKGROUND OF THE INVENTION

A variety of different types of voting equipment are currently in use, spanning the technology from a paper ballot dropped in a box to an electronic ballot presented on a screen for use by a voter. In all likelihood, today's voting equipment comprises a combination of different types of voting media and, in fact, there remains a heightened level of trust associated with a voting process that creates a "paper trail" that may later be used to confirm the tabulated votes.

Thus, many jurisdictions utilize electronic voting machines that include the capability of scanning individual paper ballots to tabulate the voter's choices. As a result, a voter-verifiable paper record of actual votes cast on an individual machine may be created and retained. The paper record can then be compared to the scanned results and vote tallies for auditing purposes. Conventional machines of this type typically allow for the paper ballots to drop down into the interior of the machine after being scanned.

Depending on the physical properties of such electronic voting machines, the actual paper ballots may adhere to an inner wall of the machine, become stuck within a small opening where sidewalls of a machine join together, etc. Additionally, if the individual paper ballots are permitted to just accumulate in a "loose" fashion within an inner cavity of the voting machine, there may arise a concern in security when the machine is later emptied to transfer the paper ballots to another container for storage.

SUMMARY OF THE INVENTION

The needs remaining in the art are addressed by the present invention, which relates to a secure ballot collection system including a removable container for inclusion within a voting machine for collecting paper ballots as they are cast, the container itself capable of being sealed after removal from the voting machine to ensure the security of the paper ballots.

In accordance with the principles of the present invention, the secure ballot collection system includes a removable ballot container bag that is placed within a voting machine, particularly located on a raised floor platform that is also positioned within the interior of the voting machine. The platform is used to position the removable ballot container bag so as to be in line with an access opening formed in the voting machine. That is the platform is sufficiently "raised" with respect to the floor of the voting machine so that an election official has easy access to the interior of the voting machine from a side opening and allows for the ballot container bag to be located at a height where it is relatively straightforward for an individual to place an "empty" container bag prior to beginning of the voting process, as well as remove a "filled" container bag at some point in time thereafter. The container bag itself may be sized to hold a predetermined number of paper ballots (for example, 500 ballots), so that after that number of ballots has been cast, the voting machine is "paused" and opened; the filled container bag is removed (and secured) and an empty bag is put in its place on the raised floor platform. Once the empty bag is in position, the voting process is resumed and carries on in similar fashion.

The raised floor platform is preferably formed of a transparent material (such as an acrylic) so that any stray ballots may be easily identified and put in the container bag before its removal. In an exemplary embodiment, the raised floor platform comprises a top surface element that is supported by a plurality of posts. The top surface element is preferably configured to follow the contour of the voting machine so that it is essentially flush with the inner surface of the machine. The contoured design of the top surface element further assures that the platform is consistently positioned at the same location in each machine of that type. Additionally, a number of alignment marks (which may be holes) are preferably formed at selected locations on the top surface element. These alignment marks will mate with fiducial members formed on the bottom surface of the container bag (e.g., rounded stand-offs as found on luggage or similar containers). In this manner, each container bag will be in registered alignment with the platform and the voting machine such that ballots passing through the scanner will naturally fall into the opened container.

The container bag itself preferably takes the form of a case with an attached ("hinged") lid, where the lid of the case is opened once the container bag is placed in the voting machine. When a known number of ballots have been collected within the container bag (as determined by tally count being performed), the voting machine is opened to allow access to the container bag. The lid of the case is closed and the container bag is removed from the machine. A "new" (i.e., empty) container bag is then positioned in place within the machine and the ballot collection process continues.

In preferred embodiments of the present invention, the container bag includes a diverter arrangement for ensuring the directional flow of the paper ballots into a central region of the bag. Embodiments may also include some means for removably attaching the raised lid to an interior wall of the voting machine itself so as to ensure that the container remains in its "open" position. Preferably, the raised floor platform and the container bag include registration fiducials so that each container bag is positioned in the same location on the platform.

An exemplary embodiment of the present invention may take the form of a secure collection device for paper ballots comprising a removable container bag for positioning within an interior region of a voting machine and a raised floor platform for supporting the removable container bag. The removable container bag comprises a case with an attached lid including means for securely closing the lid against the case when full, with the dimensions of an interior collection area of the case configured to hold a predetermined number of paper ballots. In particular, the removable container bag is located so that cast paper ballots accumulate within its interior collection area. The raised floor platform is disposed under the removable container bag and sized to present the removable container bag at a defined height above a floor surface of the voting machine.

Other and further embodiments and aspects of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
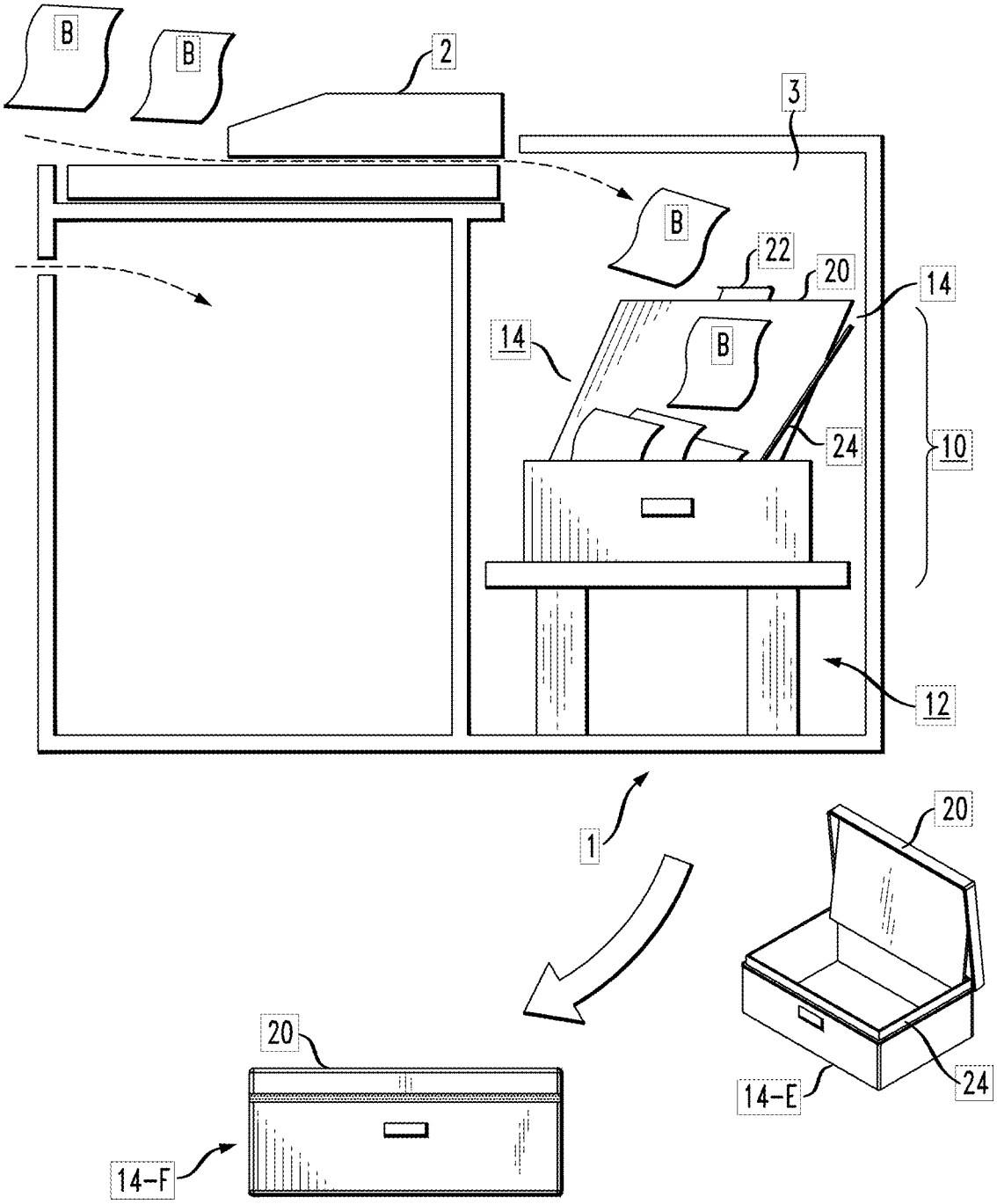
FIG. 1 is a simplified diagram of a conventional voting machine configured to include the secure paper ballot collection system of the present invention.

FIG. 1 is a simplified diagram of a conventional voting machine 1 within which a secure paper ballot collection system 10 of the present invention may be utilized. Voting machine 1 is shown in this example as including a scanning system 2 for optically reading separate ballots B as they are inserted into the machine. Upon being read (i.e., "tabulated"), the ballots B drop into an interior portion 3 of voting machine 1.

Figure 2:
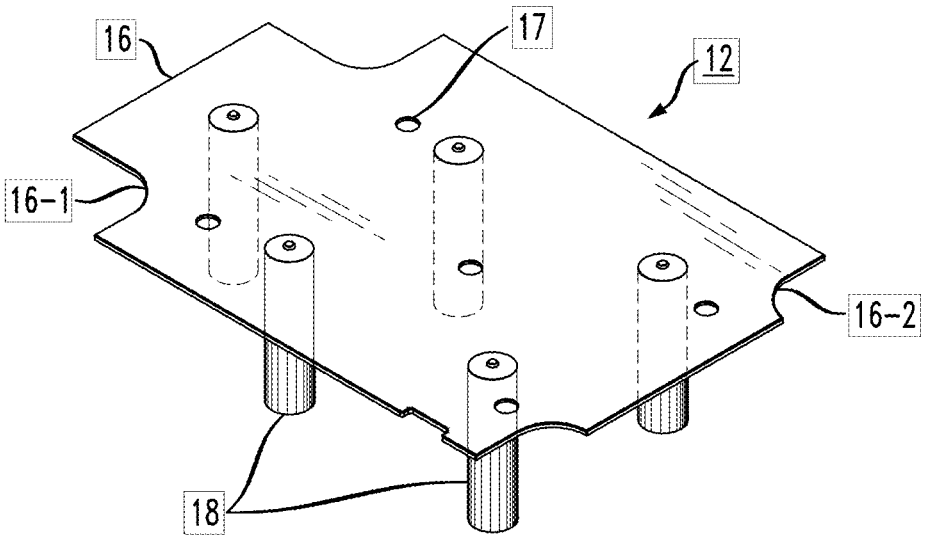
FIG. 2 is an isometric view of an exemplary raised floor platform component of the inventive system.
Figure 3:
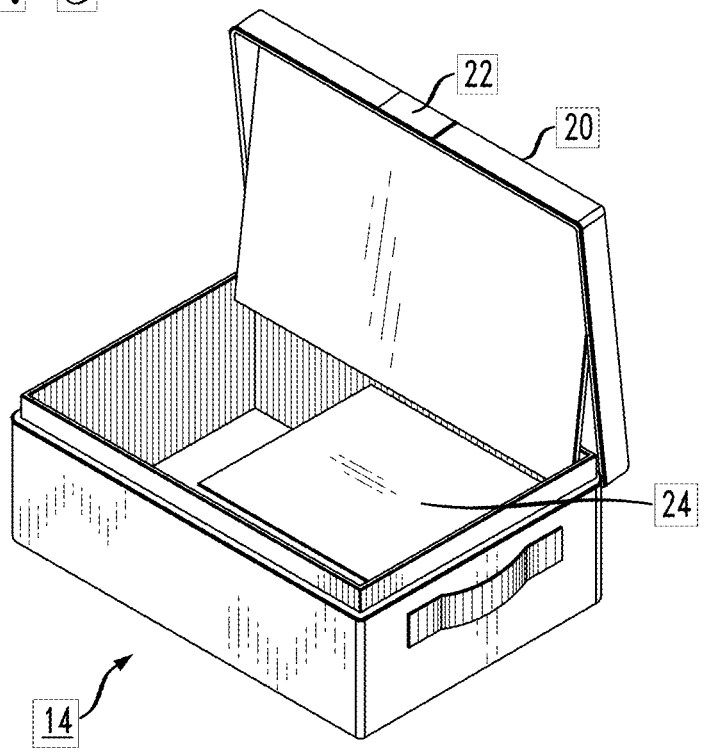
FIG. 3 is an isometric view of an exemplary removable container bag component of the inventive system.

In accordance with the principles of the present invention, instead of having the ballots just drop down and perhaps become misplaced, stuck, etc., secure paper ballot collection system 10 is used to capture each ballot as it exits scanning system 2. In particular, collection system 10 includes a raised floor platform 12 and a removable ballot container bag 14 that is positioned in place as shown on raised floor platform 12. FIG. 2 is an isometric view of an exemplary raised floor platform 12 and FIG. 3 is an isometric view of an exemplary removable ballot container bag 14.

Referring again to FIG. 1, the scanned paper ballots B are depicted as falling into the open interior of container bag 14. As mentioned above, an exemplary container bag is sized to hold a given number of paper ballots (e.g., 500 ballots). Once this maximum number of ballots has been cast, the voting machine is paused, the filled container bag 14-F is removed and an empty container bag 14-E is positioned on platform 12. The voting process is then resumed and continues until that container bag is full, where it is then removed and replaced, with the voting process continuing in this manner. Each container bag 14 is preferably sealed with a tamper-evident locking arrangement to ensure that the paper ballots within the container bag are not accessible.

Figure 4:
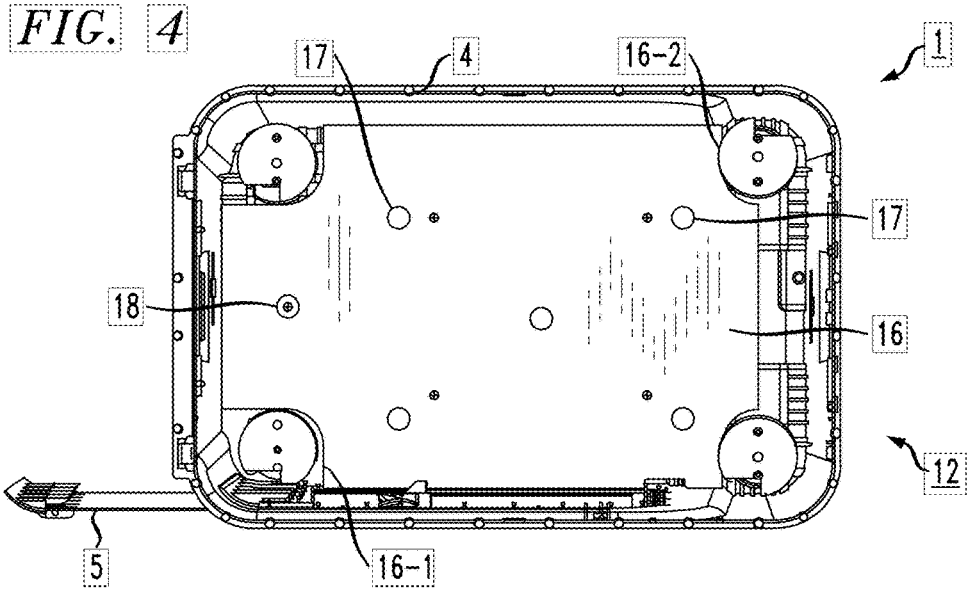
FIG. 4 is a cut-away top view of a voting machine, illustrating the placement of the raised floor platform component of the inventive system.
Figure 5:
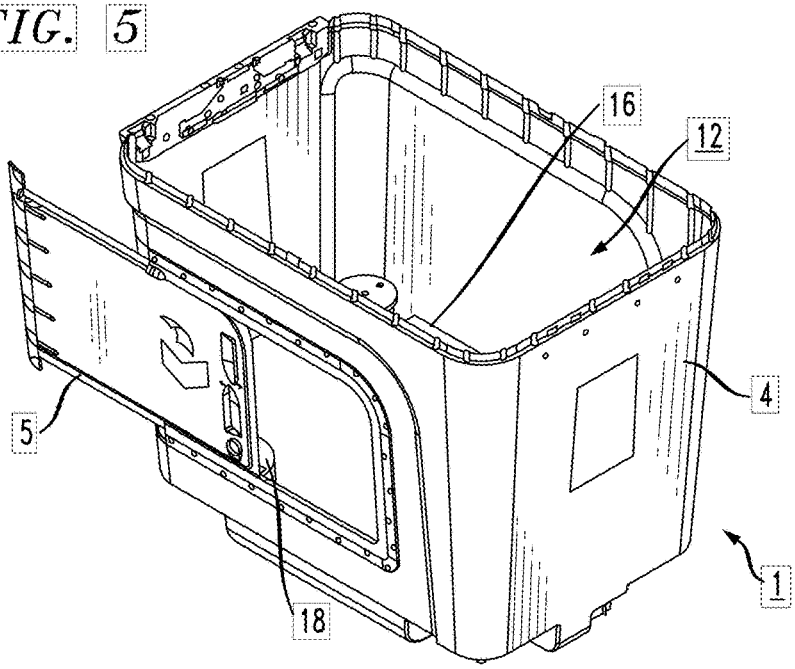
FIG. 5 is an isometric view of the configuration of FIG. 4.

In the particular embodiment shown in FIG. 2, raised floor platform 12 comprises a top member 16 and a plurality of support posts 18. As evident from the illustration of FIG. 2, top member 16 is configured to exhibit shape that matches the contours of the voting machine within which it will be placed. By matching the geometry of top member 16 to voting machine 1, the ability for an individual ballot to drop below platform 12 is substantially reduced. FIG. 4 is a cut-away top view of voting machine 1 with raised floor platform 12 in place, and FIG. 5 is an isometric view of the positioning of raised floor platform 12 within voting machine 1 (the view of FIG. 5 showing only the body portion 4 of voting machine 1 for the purposes of clarity). The various contours 16-1, 16-2, etc., as illustrated in the isometric view of FIG. 2, are shown as accommodating the interior contours of voting machine 1 as depicted in FIG. 4.

In a preferred embodiment, top member 16 of platform 12 incudes a plurality of alignment registration holes 17, as shown in FIGS. 2 and 4. Alignment registration holes 17 are strategically located so that they will mate with alignment features formed on the bottom of each container bag 14. As discussed below, the alignment features may take the form of "stand-offs", similar to the "feet" of a suitcase type of container. The ability to ensure repeatable alignment between platform 12 and container bag 14 (which is also determined with respect to the position of scanner system 2 and the path the ballots follow after being scanned) provides further assurance that each scanned paper ballot will be captured within the container bag, assuring integrity of the vote count.

Preferably, top member 16 of raised floor platform 12 is formed of a transparent material (for example, an acrylic) so that if any ballots somehow drop below platform 12, they are immediately visible to the individual removing a filled container bag and retrieved to also be placed within the filled container bag as it is being removed.

Turning now to a detailed description of exemplary container bag 14, FIG. 3 shows container bag 14 as including an attached lid 20 that is raised once container bag 14 is in place on platform 12. Preferably, the outer surface of lid 20 contains at least one releasable attachment mechanism 22, such as a typical hook-and-loop arrangement, that mates with a similar mechanism formed on an interior sidewall body portion 4 of voting machine 1 (not shown in FIG. 2). In this manner, lid 20 will be remain raised and held in place as the ballots enter container bag 14, with the position of the lid further ensuring that the ballots are directed into the container and do not drop into the lower portion of voting machine 1. As also shown in FIG. 3, container bag 14 may include one or more diverter flaps 24 that may be raised in a manner similar to lid 20 and attached (via hook-and-loop means, for example) to other interior portions of voting machine body 4. As will be discussed below in association with FIGS. 7 and 8, diverter flaps 24 provide additional assurance that all of the tallied paper ballots will be directed into container bag 14.

Figure 6:
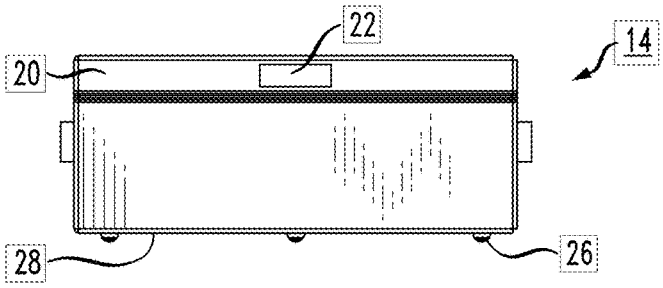
FIG. 6 is a simplified side view of an exemplary removable container bag component, particularly illustrating alignment features formed along a bottom surface thereof.
Figure 7:
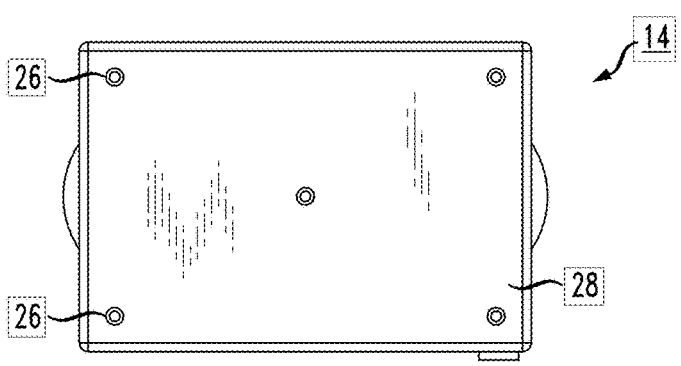
FIG. 7 is a simplified bottom view of the removable container bag of FIG. 6, clearly illustrating the position of a set of alignment features.

FIG. 6 is a simplified side view of container bag 14, illustrating a plurality of stand-offs 26 that are formed on bottom surface 28 of container bag 14. FIG. 7 is a view of the bottom of container bag 14, clearly showing in this embodiment a set of five stand-offs 26 disposed at specific locations on bottom surface 28. As discussed above, stand-offs 26 are positioned to align to and engage with alignment registration holes 17 formed in top surface element 16 of raised floor platform 12. By aligning stand-offs 26 with registration holes 17, the positioning of each container bag 14 on platform 12 will be the same, since it is presumed that a particular voting process will require the use of multiple container bags. The alignment of each container bag 14 with respect to scanning system 2 of voting machine 1 adds further assurance that each paper ballot will be directed to the same location within the interior of an opened container bag.

Figure 8:
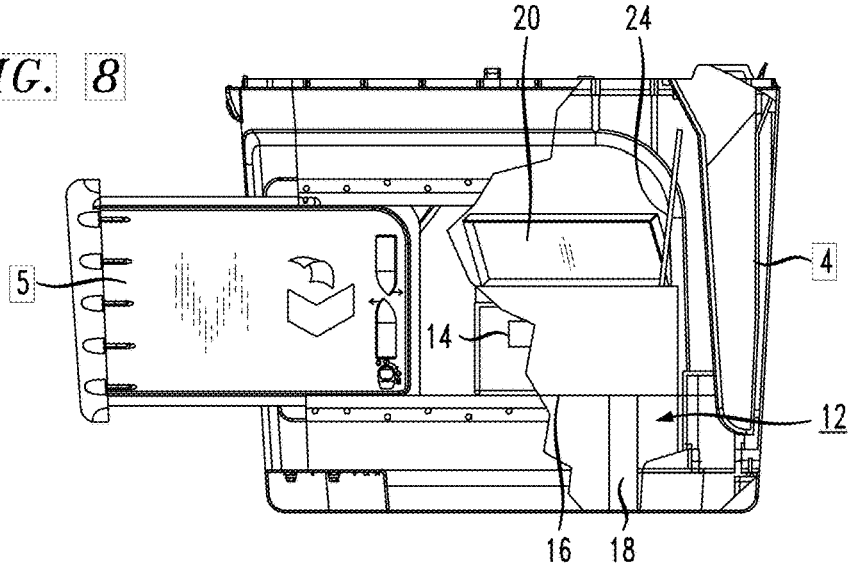
FIG. 8 is a simplified side view of a voting machine showing the positioning of the raised floor platform and removable container bag.
Figure 9:
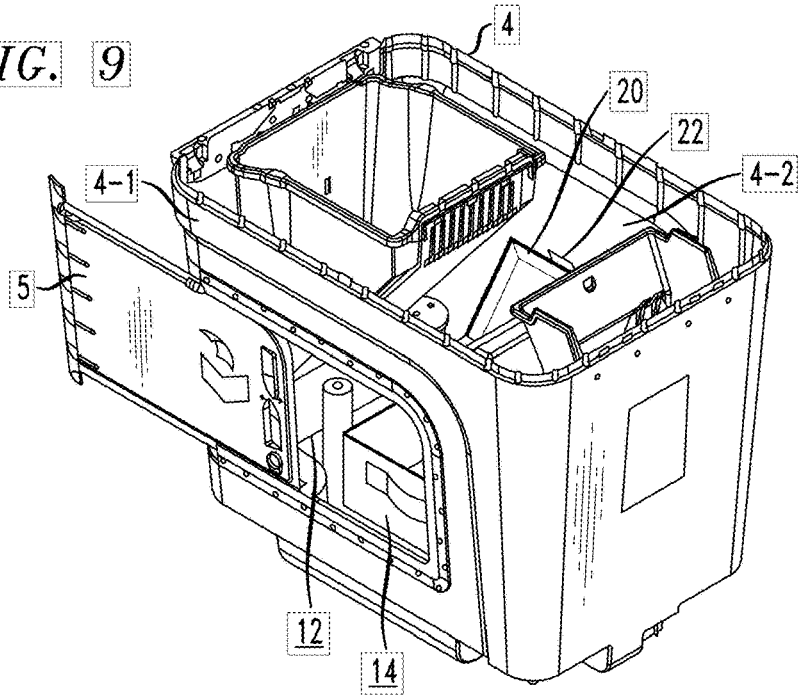
FIG. 9 is an isometric view of the configuration of FIG. 8.

FIG. 8 is a simplified side view of voting machine 1, illustrating the location of raised floor platform 12 and container bag 14 within body portion 4 of voting machine 1. FIG. 9 is an associated isometric view. In this configuration, machine 1 includes a sliding door 5 along one sidewall 4-1 of voting machine body 4 that provides access to the interior portion of the machine and allows an election official to quickly and easily access the positioned container bag 14. Initially, a top component of voting machine 1 is removed and raised floor platform 12 is positioned within the interior of voting machine 1. Once platform 12 is properly positioned (and other components of the voting machine repositioned in place), a removable ballot container bag 14 is inserted through opened sliding door 5 and placed upon top member 16 of platform 12, and positioned such that standoffs 26 engage with alignment markers 17 formed in top member 16.

Lid 20 of container bag 14 is raised and releasable attachment means 22 is connected with its mating counterpart formed on an interior sidewall (for example, sidewall 4-2) of voting machine body portion 4. In this raised and attached position, lid 20 provides further assurance that ballots entering voting machine 1 will be directed into container bag 14 and not otherwise fall into a recessed area within the machine. Diverter flap 24 is also raised and removably attached to another interior portion of voting machine 1 (for example, in opposition to the location of scanner 2), thus preventing paper ballots from "overshooting" the boundaries of container bag 14. Again, the inclusion of diverter flap 24 provides additional assurance that each and every cast ballot will be captured within container bag 14.

When container bag 14 is deemed to be full (for example, after capturing 500 ballots), sliding door 5 of voting machine 1 can be opened to again expose container bag 14. Lid 20 and diverter flap 24 are releasably detached from the interior of voting machine 1, with flap 24 positioned over the cast ballots and lid 20 positioned in place to close container bag 14. Depending on voting procedures, container bag 14 may be locked prior to its removal from voting machine 1. Alternatively, container bag 14 may first be removed from voting machine 1, with lid 20 thereafter secured in its closed position (via a zipper mechanism, for example).

In preferred embodiments, container bag 14 is sealed by a tamper-evident chamber lock, such as disclosed, for example, in U.S. Pat. Nos. 7,273,139 and 8,245,905, assigned to the assignee of this application.

The foregoing description is meant to be illustrative and not limiting. Indeed, various changes, modifications, additions, and the like, may become apparent to one skilled in the art and such are meant to fall within the spirit and scope of the present invention as defined by the claims appended hereto.

What is claimed is:

1. A secure collection device for paper ballots comprising:

a removable container bag for positioning within an inside location of a voting machine, the removable container bag comprising a case with an attached lid, the attached lid secured in an open position so that case paper ballots accumulate within an interior collection area within the case, with the attached lid including means for securely closing against the case when full, the dimensions of an interior collection area of the case configured to hold a predetermined number of paper ballots, wherein the removable container bag is located so that cast paper ballots accumulate within the interior collection area; and a raised floor platform disposed under the removable container bag and sized to present the removable container bag at a defined height above a floor surface of the voting machine.

2. The secure collection device as defined in claim 1, wherein the attached lid of the removable container bag further comprises a releasable attachment mechanism for securing the open position of the attached lid to a portion of the voting machine when the removable container bag is positioned within the inside location of the voting machine.

3. The secure collection device as defined in claim 1, wherein the removable container bag further comprises a diverter flap attached to a perimeter region of the case, the diverter flap including a releasable attachment mechanism for securing the diverter flap in a raised position against an interior portion of the voting machine.

4. The secure collection device as defined in claim 1, wherein the removable container bag further comprises a plurality of alignment features formed across an exterior portion of a bottom surface thereof; and the raised floor platform further comprises a plurality of alignment features formed across a top surface thereof, the alignment features of the raised floor platform located to mate with the alignment features of the removable container bag when the container bag is placed upon the raised floor platform.

5. The secure collection device as defined in claim 4 wherein the plurality of alignment features formed on the bottom surface of the removable container bag comprise a plurality of raised alignment features; and the plurality of alignment features formed on the top surface element of the raised floor platform comprise a plurality of holes, providing alignment registration with the plurality of raised alignment features of the removable container bag.

6. The secure collection device as defined in claim 1 wherein the raised floor platform is formed of a transparent material.

7. The secure collection device as defined in claim 1 wherein the raised floor platform comprises a top surface element sized to contact an inner periphery of a voting machine, following the contours thereof; and a plurality of support posts disposed below the top surface element, the height of the support posts selected to position the removable container bag at a desired height above a bottom surface of the voting machine.

* * * * *